US007490661B2

(12) United States Patent
Nishino et al.

(10) Patent No.: US 7,490,661 B2
(45) Date of Patent: Feb. 17, 2009

(54) HEAT EXCHANGER

(75) Inventors: Tatsuhiko Nishino, Obu (JP); Tetsuya Takeuchi, Kariya (JP); Yoshiki Katoh, Chita-gun (JP)

(73) Assignee: Denso Corporation, Kariya (JP)

( * ) Notice: Subject to any disclaimer, the term of this patent is extended or adjusted under 35 U.S.C. 154(b) by 321 days.

(21) Appl. No.: 11/365,899

(22) Filed: Mar. 1, 2006

(65) Prior Publication Data

US 2006/0201198 A1 Sep. 14, 2006

(30) Foreign Application Priority Data

Mar. 9, 2005 (JP) ..... 2005-066107

(51) Int. Cl.

| | |
|---|---|
| ***F28F 9/02*** | (2006.01) |
| ***F28D 1/02*** | (2006.01) |
| ***F28D 7/06*** | (2006.01) |
| ***F25B 39/02*** | (2006.01) |

(52) U.S. Cl. ..... 165/174; 165/153; 165/176; 62/525

(58) Field of Classification Search ..... 62/525; 165/174, 153, 176

See application file for complete search history.

(56) References Cited

U.S. PATENT DOCUMENTS 5,107,923 A * 4/1992 Sherman et al. ..... 165/159
6,059,026 A * 5/2000 Bailly et al. ..... 165/174
6,220,342 B1 * 4/2001 Nishishita et al. ..... 165/153
6,382,313 B2 * 5/2002 Mitsumoto et al. ..... 165/159
6,973,805 B2 12/2005 Higashiyama
2001/0017202 A1 * 8/2001 Mitsumoto et al. ..... 165/174
2002/0079093 A1 * 6/2002 Rong ..... 165/153
2004/0256091 A1 * 12/2004 Higashiyama ..... 165/153
2005/0211421 A1 * 9/2005 Ekelund et al. ..... 165/114

FOREIGN PATENT DOCUMENTS

JP 2005-030741 2/2005

* cited by examiner

*Primary Examiner*—Cheryl J Tyler
*Assistant Examiner*—Brandon M Rosati
(74) *Attorney, Agent, or Firm*—Harness, Dickey & Pierce, PLC

(57) ABSTRACT

A heat exchanger is provided with a header tank having therein a circulation portion in which fluid flows, and multiple tubes which are stacked in a longitudinal direction of the header tank. The circulation portion is communicated with interiors of the tubes, and partitioned into an inlet side passage and other passages. An inflow port member is arranged at a longitudinal-direction end of the inlet side passage, and provided with multiple openings for causing at least a mainstream flow and a substream flow of fluid introduced toward the tubes. The mainstream flow is substantially evenly flow-divided by the substream flow.

15 Claims, 7 Drawing Sheets

HEAT EXCHANGER

CROSS REFERENCE TO RELATED APPLICATION

This application is based on a Japanese Patent Application No. 2005-66107 filed on Mar. 9, 2005, the disclosure of which is incorporated herein by reference.

FIELD OF THE INVENTION

The present invention relates to a heat exchanger. The heat exchanger is suitably used as, for example, an evaporator of a refrigerant cycle system.

BACKGROUND OF THE INVENTION

Generally, a heat exchanger is provided with multiple tubes which are stacked, and two header tanks which are respectively arranged at two longitudinal-direction ends of the tube, for example, referring to JP-2005-30741A.

In this case, one of the header tanks has therein an inlet side passage and an outlet side passage. A flow dividing plate is arranged in the inlet side passage to flow-divide refrigerant (having been introduced) into the portion (of inlet side passage) near an inflow port of the inlet side passage and the longitudinal-direction inner portion of the inlet side passage, in order to restrict an uneven flow of refrigerant at the portion near the inflow port and the longitudinal-direction inner portion of the inlet side passage. Thus, refrigerant can be evenly shunted to flow into the multiple tubes which are stacked in the longitudinal direction of the header tank.

Referring to U.S. Pat. No. 6,973,805-B2, a round inflow port is arranged at the upstream end of the inlet side passage, and covered by a fluid-dispersing member which has a spherical surface shape and is provided with multiple small holes. Fluid which is issued through the small holes flow upwards and downwards due to the spherical surface of the fluid-dispersing member. Thus, a refrigerant dispersion effect is improved.

However, in the case of JP-2005-30741A, fluid is evenly shunted to flow into the tubes in a limited flow amount range of refrigerant. It is significantly difficult to set the suitable arrangement position and the suitable length of the flow dividing plate for the even flow of refrigerant into the multiple tubes, with respect to a large flow amount range of refrigerant, for example 30-180kg/h.

In the case where the refrigerant flow amount is large, refrigerant easily flows to the longitudinal-direction inner portion of the header tank. Thus, the flow dividing plate is located away from the inflow port, and the length of the flow dividing plate is to be shortened. On the other hand, in the case where the refrigerant flow amount is small, refrigerant relatively easily flows downwards to the portion near the inflow port of the inlet side passage. Thus, the flow dividing plate is arranged near the inflow port, and the length of the flow dividing plate is to be enlarged. Therefore, it is difficult to evenly flow-divide refrigerant with respect to a large flow amount range of refrigerant.

Moreover, U.S. Pat. No. 6,973,805-B2 fails to teach in detail the diameter of the small hole formed at the fluid-dispersing member. In the case where the diameter of the small hole is set about 1 mm, for example, the pressure loss of refrigerant will increase when the refrigerant flow amount is large. Thus, the efficiency of the refrigerant cycle system is decreased.

Moreover, referring to FIGS. 5A and 5B of U.S. Pat. No. 6,973,805-B2, it is also described that only the lower half portion of the round inflow port is coved by a fluid-dispersing member, which has a semi-spherical surface shape and is provided with multiple small holes. In this case, the flow-dividing ratio of refrigerant between the upper half portion and the lower half portion of the inflow port is about 200:1. That is, most of refrigerant flows through the upper half portion of the inflow port into the header tank. Thus, it is difficult to evenly flow-divide refrigerant in a large flow amount range.

Furthermore, referring to FIGS. 7A and 7B of U.S. Pat. No. 6,973,805-B2, it is also described that multiple small holes are arranged around the round inflow port. In this case, the flow-dividing ratio of refrigerant between the inflow port and the small holes is about 100:1. That is, most of refrigerant flows into the header tank through the inflow port which has a relatively large opening. Thus, it is difficult to evenly flow-divide refrigerant in a large flow amount range.

SUMMARY OF THE INVENTION

In view of the above-described disadvantage, it is an object of the present invention to provide a heat exchanger, in which refrigerant is substantially evenly flow-divided from a header tank into tubes thereof with respect to a large flow amount range of refrigerant.

According to the present invention, a heat exchanger has a plurality of tubes which are stacked, a header tank defining therein a circulation portion in which fluid flows. The header tank extends in a stacking direction of the tubes. The header tank is connected with a longitudinal-direction end of each of the tubes, so that the circulation portion of the header tank is communicated with interiors of the tubes. The circulation portion is partitioned into an inlet side passage and other passages. The header tank has an inflow port member which is arranged at a longitudinal-direction end of the inlet side passage and provided with a plurality of openings for causing at least a mainstream flow and a substream flow of fluid introduced toward the tubes. The openings are constructed so that the mainstream flow is substantially evenly flow-divided by the substream flow.

Thus, in the case of the small flow amount of fluid (refrigerant), the large part of refrigerant which flows through the inflow port member into the inlet side passage in the longitudinal direction thereof will flow through the mainstream opening into the part (of inlet side passage) near the inflow port member, to cause the mainstream flow with a low flow speed. Moreover, the small part of refrigerant will flow into the longitudinal-direction inner portion of the inlet side passage through the substream opening, to cause the substream flow having a relatively high flow speed.

On the other hand, when the refrigerant flow amount is large, the mainstream flow can flow into the part of the inlet side passage near the inflow port member due to the substream flow caused by the substream opening. Accordingly, fluid can be substantially evenly flow-divided from the inlet side passage into the tubes even when the heat exchanger is provided with refrigerant in a large flow amount range.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

First Embodiment

A heat exchanger 100 according to a first embodiment of the present embodiment will be described with reference to FIGS. 1-7. The heat exchanger 100 is suitably used as, for example, an evaporator of a refrigerant cycle system.

Figure 1:
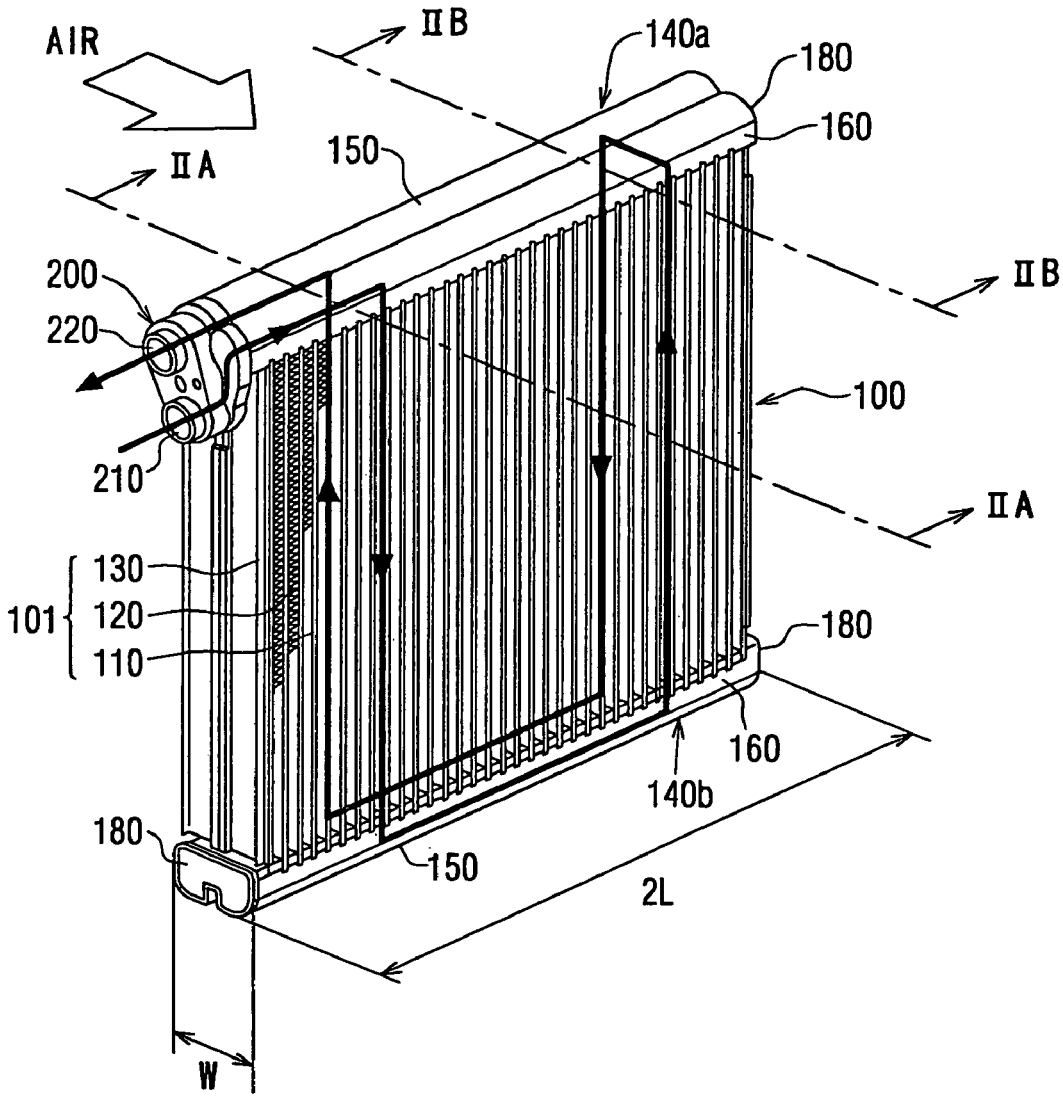
FIG. 1 is a perspective view showing a whole construction of an evaporator according to a first embodiment of the present invention.

FIG. 1 shows the evaporator 100 of a two-pass U-turn type, which is provided with therein a front-rear (with respect to exterior air flow direction) flow of refrigerant. In this case, refrigerant (fluid) having been decompressed in an expansion valve (not shown) which is disposed at a refrigerant upstream side is introduced into the evaporator 100 through a fluid inlet 210 thereof (described later). Refrigerant flows in the evaporator 100 as shown by the arrows in FIG. 1, and is heat-exchanged with exterior air to be evaporated into gas, which is discharged to a refrigerant downstream side.

Figure 2A:
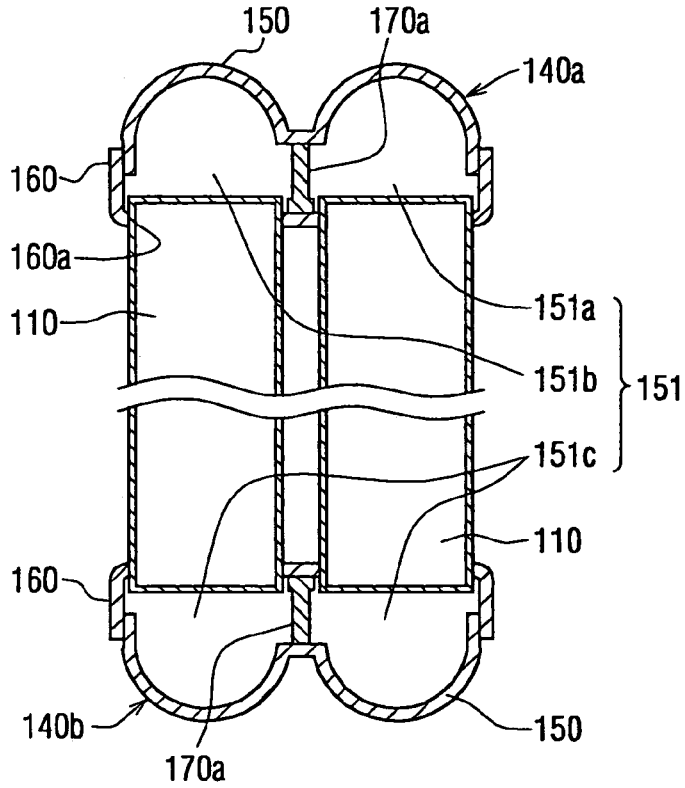
FIG. 2A is a cross-sectional view in a IIA-IIA direction in FIG. 2.
Figure 2B:
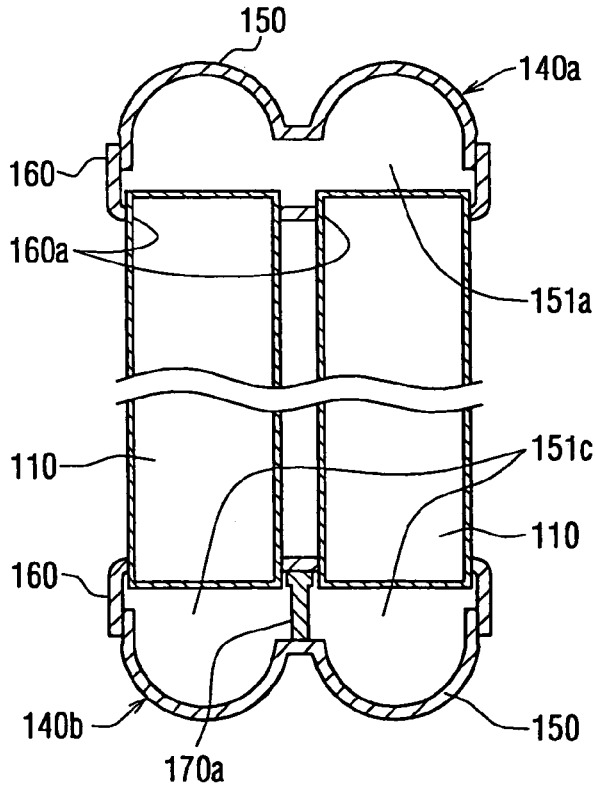
FIG. 2B is a cross-sectional view in a IIB-IIB direction in FIG. 2.

As shown in FIGS. 1-2B, the evaporator 100 is provided with a core unit 101, an upper header tank 140*a* and a lower header tank 140*b*, which are made of aluminum, an aluminum alloy or the like. The thickness (core thickness) of the core unit 101 is indicated by W. The length (two-pass core length) of the core unit 101 is indicated by 2L. The per-pass core length is indicated by L. That is, the tubes 110 which are stacked and communicated with an inlet side passage 151*a* (described later) are provided with the per-pass core length L.

The core unit 101, the header tanks 140*a* and 140*b* are assembled by engaging, swaging, jig-fastening or the like, and then integrated with each other by brazing through a braze material which is beforehand provided to the surfaces of the core unit 101, the header tanks 140*a* and 140*b*.

The core unit 101 includes multiple core members which are arrayed in the core-thickness-direction direction (corresponding to exterior air flow direction). For example, the core unit 101 can be provided with the two core members which are respectively arranged at an air upstream side and an air downstream side.

Each of the core members of the core unit 101 is provided with multiple tubes 110 in which refrigerant flows, multiple corrugated fins 120, and two side plates 130, each of which has a cross section with a ⊐shaped opening to be used as a reinforce member. The tubes 110 and the fins 120 are alternately stacked. That is, each of the fins 120 is sandwiched between the adjacent tubes 110. The two side plates 130 are respectively arranged at the further outsides of the fins 120 disposed at the outmost side of the stack direction of the fins 120 (tubes 110).

In this case, the multiple tubes 110 of the core member at the air upstream side constructs a returning tube group, and the multiple tubes 110 of the core member at the air downstream side construct a going tube group. That is, the going tube group and the returning tube group are arranged in the core-width direction (i.e., exterior air flowing direction). The refrigerant flow direction in the returning tube group is contrary to that in the going tube group.

The two longitudinal-direction ends of the tube 110 are respectively connected with the header tanks 140*a* and 140*b*, which extends in the stacking direction of the tubes 110. That is, the longitudinal direction of the header tank 140*a*, 140*b* corresponds to the stack direction of the tubes 110.

Figure 3:
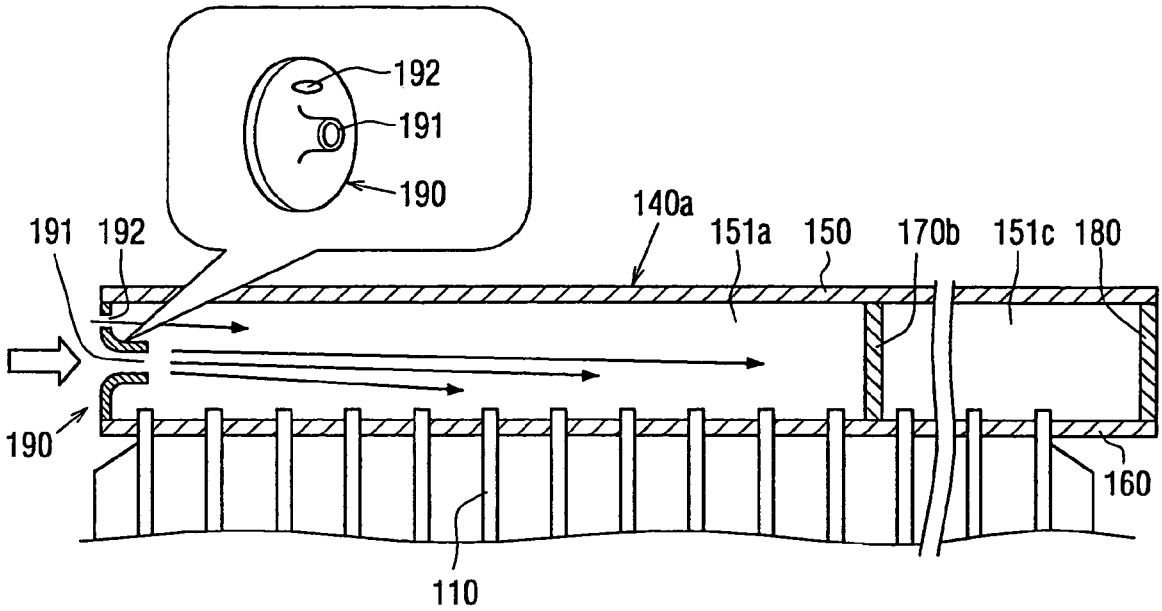
FIG. 3 is a schematic longitudinal sectional view showing an inner construction of a header tank according to the first embodiment.

As shown in FIGS. 2A-3, each of the header tanks 140*a* and 140*b* is provided with a tank plate 150 and a tube plate 160. The tank plate 150 is constructed of a plate material by pressing or the like so that a circulation portion 151 (defined by tank plate 150 and tube plate 160) of the header tank 140*a*, 140*b* is provided with a cross section having a substantially multi-U-like shape, for example.

The tube plate 160 is constructed of a plate material by pressing or the like to have a substantially ⊐-like shape, and provided with multiple insertion holes 160*a* which are positioned corresponding to the arrangement of the longitudinal-direction ends of the tubes 110. Referring to FIG. 1, the upper ends (with respect to gravity direction) of the tubes 110 are inserted through the insertion holes 160*a* formed at the upper header tank 140*a*, and fixed to the upper header tank 140*a*. The lower ends (with respect to gravity direction) of the tubes 110 are inserted through the insertion holes 160*a* formed at the lower header tank 140*a*, and fixed to the lower header tank

140*a*. Thus, the circulation portions 151 in the header tanks 140*a* and 140*b* are communicated with the interior of each of the tubes 110.

As shown in FIGS. 2A-3, the upper header tank 140*a* is further provided with therein partition plates 170*a* and 170*b* for partitioning the circulation portion 151 in the upper header tank 140*a* into the inlet side passage 151*a*, an outlet side passage 151*b* and other passage 151*c*. Specifically, the inlet side passage 151*a* is separated from the outlet side passage 151*b* by the partition plate 170*a*. The inlet side passage 151*a* and the outlet side passage 151*b* are separated from the other passage 151*c* by the partition plate 170*b*.

The lower header tank 140*b* is further provided with therein the partition plate 170*a* for partitioning the circulation portion 151 in the lower header tank 140*b* into the two other passages 151*c*.

A connection member 200 is arranged at one longitudinal-direction end of the upper header tank 140*a* (i.e., ends of inlet side passage 151*a* and outlet side passage 151*b*). The fluid inlet 210 and a fluid outlet 220 are formed at the connection member 200. The fluid inlet 210 is communicated with the inlet side passage 151*a*, and the fluid outlet 220 is communicated with the outlet side passage 151*b*.

The other longitudinal-direction end (which is opposite to side of connection member 200) of the upper header tank 140*a* is closed by an end plate 180. Two longitudinal-direction ends of the lower header tank 140*b* are respectively closed by the two end plates 180.

The upper header tank 140*a* is provided with an inflow port member 190 for evenly flow-dividing refrigerant from the inlet side passage 151*a* into the tubes 110, which are stacked in the longitudinal-direction of the header tank 140*a*, 140*b*. According to this embodiment, the inflow port member 190 is constructed to substantially flow-divide refrigerant with respect to a large flow amount range (e.g., about 30-180 kg/h) of refrigerant, which is introduced into the inlet side passage 151*a*.

As shown in FIG. 3, the inflow port member 190 has a substantial plate shape, and is made of a same material with that of the header tank 140*a*, 140*b*. The inflow port member 190 is arranged at the refrigerant upstream end of the inlet side passage 151*a*, that is, at the one end of the upper header tank 140*a* (into which refrigerant firstly flows after being introduced into heat exchanger 100). A mainstream opening 191 and a substream opening 192, through which refrigerant flows into the upper header tank 140*a*, are formed at the inflow port member 190. The openings 191 and 192 penetrate the inflow port member 190.

The inflow port member 190 can be also provided with multiple construction units including, for example, the end portion of the material constructing the upper header tank 140*a*. In this case, the openings 191 and 192 can be formed between the inflow port member 190 and the other construction unit, for example, the end portion of the material constructing the header tank 140*a*.

The inflow port member 190, just like as a cover, is fixed at the refrigerant upstream side end of the inlet side passage 151*a*. The peripheral shape of the inflow port member 190 coincides with that of the cross section of the inlet side passage 151*a*. The inflow port member 190 has a portion (funnel-shaped portion) with a substantial funnel shape. The funnel-shaped portion is positioned at the substantial center of the inflow port member 190, and has a smooth curved outer surface and a smooth curved inner surface.

The inflow port member 190 is arranged so that a large-diameter end of the funnel-shaped portion is disposed at the refrigerant upstream side and a small-diameter end of the funnel-shaped portion is disposed at the refrigerant downstream side. In this case, the funnel-shaped portion of the inflow port member 190 constructs a substantially cylinder-shaped nozzle, which extends in the axial direction of the inlet side passage 151*a*. The small-diameter end of the nozzle (funnel-shaped portion) is positioned at the relatively inner side of the inlet side passage 151*a* compared with the large-diameter end of the nozzle.

The upstream side surface (at funnel-shaped portion) of the inflow port portion 190 is a substantially cone-shaped surface having a passage cross section which becomes gradually smaller toward the inner side of the inlet side passage 151*a*. The downstream side surface (i.e., surface at side of inlet side passage 151*a*) of the funnel portion of the inflow port member 190 is a substantially cone-shaped surface having an outer diameter which becomes gradually smaller toward the inner side of the inlet side passage 151*a*.

According to this embodiment, the mainstream opening 191 is formed at the small-diameter end of the funnel-shaped portion of the inflow port member 190. The substream opening 192, being a penetration hole formed at the inflow port member 190, is arranged at the gravity-direction upper side of the funnel-shaped portion and positioned between the funnel-shaped portion and the peripheral edge of the inflow port member 190.

The substream opening 192 has a flat shape (e.g., substantial ellipse) with a longitudinal axis in a tangential direction of an imaginary round which is concentric with the mainstream opening 191. The substream opening 192 is arranged so that the part (of substream opening 192) having the largest gravity-direction width is positioned at the upper side of the center of the mainstream opening 191.

As described above, the mainstream opening 191 is arranged at the small-diameter end of the funnel-shaped portion of the inflow port member 190, and positioned at the relatively inner side of the inlet side passage 151*a* compared with the substream opening 192. The substream opening 192 is separated from the mainstream opening 191 by a smoothly curved portion because of the formation of the funnel-shaped portion at the inflow port member 190.

Figure 4:
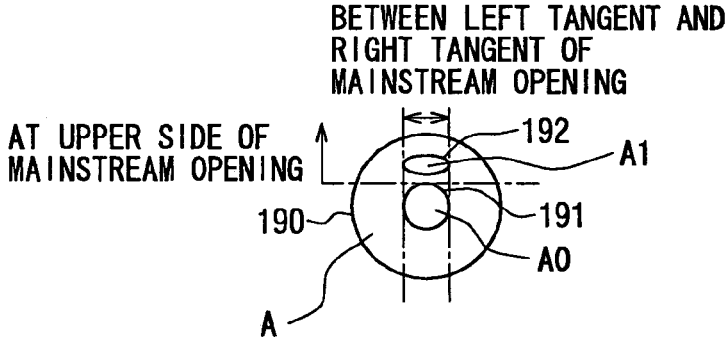
FIG. 4 is a schematic view showing an optimal position relation between a mainstream opening portion and a substream opening portion arranged at an inflow port member according to the first embodiment.

As shown in FIG. 4, the area of the cross section (which is perpendicular to longitudinal direction of inlet side passage 151*a*) of the inflow port member 190 (or inlet side passage 151*a*) is indicated by A, the opening area of the mainstream opening 191 is indicated by A0, and the opening area of the substream opening 192 is indicated by A1. The opening area ratio A0/A (i.e. ratio of opening area A0 of mainstream opening 191 to cross section area A of inflow port member 190) of the mainstream opening 191 is set substantially in a range of 0.07-0.15. The opening area ratio A1/A (i.e. ratio of opening area A1 of substream opening 192 to cross section area A of inflow port member 190) of the substream opening 192 is set substantially in a range of 0-0.08.

The opening area ratio A1/A (opening rate) of the substream opening 192 can be decreased as possible, and is set larger than 0 in this embodiment. The opening area A0 of the mainstream opening 191 is smaller than the cross section area A of the inflow port member 190, and the opening area A1 of the substream opening 192 is smaller than the opening area A0 of the mainstream opening 191.

The optimal position of the substream opening 192 is shown in FIG. 4. As indicated by the arrows in FIG. 4, the substream opening 192 is positioned at the upper side of the upper end of the mainstream opening 191, and arranged between two tangents (of mainstream opening 191) which are respectively to the right end and the left end of the mainstream opening 191. That is, the substream opening 192 is arranged within the part defined between the right end tangent (right tangent) and the left end tangent (left tangent) of the mainstream opening 191. The upper end, the right end and the left end of the mainstream opening 191 are defined with respect to the arrangement of the inflow port member 190 shown in FIG. 4.

The optimal values of the opening area A0 of the mainstream opening 191 and the opening area A1 of the substream opening 192 will be described later.

Figure 5:
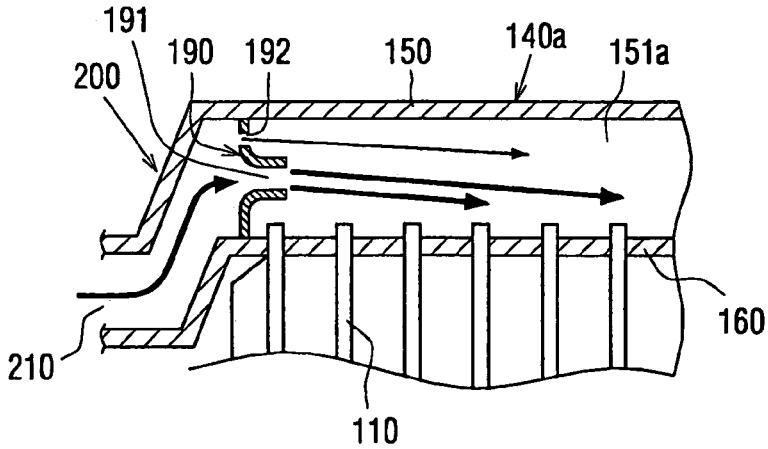
FIG. 5 is a partial schematic longitudinal sectional view showing a position relation between the inflow port member and a fluid inlet according to the first embodiment.

As shown in FIGS. 1 and 5, the connection member 200 where the fluid outlet 220 and the fluid inlet 210 are arranged is fixed to the one end (i.e., ends of inlet side passage 151*a* and outlet side passage 151*b*) of the header tank 140*a*. The connection member 200 is disposed at the upper portion of the side surface (perpendicular to longitudinal direction of header tank 140*a*) of the heat exchanger 100, which has a substantial flat rectangular-parallelepiped shape. The connection member 200 is positioned at the refrigerant upstream side of the inflow port member 190.

The fluid outlet 220 is arranged at the upper portion of the connection member 200, and protrudes from the header tank 140*a* in the longitudinal direction of the header tank 140*a*. The fluid inlet 210 is disposed at the slightly lower side of the fluid outlet 220 and the inlet side passage 151*a*, referring to FIG. 5. That is, the fluid inlet 210 is positioned at the gravity-direction lower side of the inflow port member 190. Therefore, refrigerant will flow into the mainstream opening 191 and the substream opening 192 from the lower side of the mainstream opening 191 and the substream opening 192.

That is, an ascent passage is formed in the connection member 200. The ascent passage upwards extends from the fluid inlet 210 to the upstream side surface (i.e., back surface) of the inflow port member 190 along the side surface of the heat exchanger 100. The ascent passage is arranged between the fluid inlet 210 and the back surface of the inflow port member 190. The opening of the large-diameter end of the funnel-shaped portion of the inflow port member 190 is nearer to the fluid inlet 210, than the substream opening 192 of the inflow port member 190.

Next, the effect of the heat exchanger 100 will be described. In this embodiment, the fluid outlet 220 of the heat exchanger 100 is connected with a suction side of a compressor (not shown), and the fluid inlet 210 thereof is connected with the expansion valve.

As indicated by the arrows in FIG. 1, with the operation of the refrigerant cycle system provided with the compressor and the expansion valve, refrigerant having been decompressed by the expansion valve (not shown) flows into the fluid inlet 210 of the upper header tank 140*a* and is introduced into the inlet side passage 151*a* through the inflow port member 190. Thereafter, refrigerant flows downwards through the tubes 110 of the going tube group into the other passage 151*c* in the lower header tank 140*b*. Then, refrigerant flows upwards through the tubes 110 of the going tube group into the other passage 151*c* in the upper header tank 140*a*.

Thereafter, refrigerant from the other passage 151*c* of the upper header tank 140*a* flows downwards through the tubes 110 of the returning tube group, into the other passage 151*c* of the lower header tank 140*b*. Then, refrigerant flows upwards through the tubes 110 of the returning tube group into the outlet side passage 151*b* of the upper header tank 140*a*, and is discharged from the heat exchanger 100 through the fluid outlet 220.

While refrigerant flows in the heat exchanger 100 as described above, refrigerant is heat-exchanged in the core unit 101 with exterior air having the flow direction perpendicular to the longitudinal direction of the header tank 140*a*, to be evaporated into gas which will be introduced to the suction side of the compressor.

Next, the function of the inflow port member 190 will be described. In the case where refrigerant introduced into the fluid inlet 210 has a small flow amount, a large part of refrigerant will flow through the mainstream opening 191 which has a relatively large opening area (to provide small refrigerant pressure loss), to cause a mainstream flow in the inlet side passage 151*a*. A small part of refrigerant will flow through the substream opening 192 which has a small opening area (to provide high refrigerant flow speed), to cause a substream flow in the inlet side passage 151*a*.

In this case, the upward inertial force of the mainstream flow of refrigerant is limited by the substream flow of refrigerant, while flowing toward the longitudinal-direction inner side of the inlet side passage 151*a*. Therefore, refrigerant introduced into the header tank 140*a* can be evenly flow-divided to flow into the tubes 110 (including those positioned near fluid inlet 210) of the heat exchanger 100.

When the flow amount of refrigerant introduced into the fluid inlet 210 is gradually increased, the flow speeds of the mainstream flow and the substream flow become high to flow into the longitudinal-direction inner side of the inlet side passage 151*a*.

Because the opening area A0 of the mainstream opening 191 and the opening area A1 of the substream opening 192 are respectively provided with the optimal values (described later), the mainstream flow having the upward inertial force is speed-decreased (limited) by the substream flow having the high flow speed, to become a downward flow. Therefore, refrigerant can be evenly flow-divided to flow into the tubes 110 (including those positioned near fluid inlet 210) of the heat exchanger 100.

It is investigated by the inventors of the present invention the relation among the cross section area A of the inflow port member 190, the opening area A0 of the mainstream opening 191 and the opening area A1 of the substream opening 192 with respect to a range (e.g., about 30-180 kg/h) of a flow amount Gr of refrigerant introduced into the fluid inlet 210.

Figure 6:
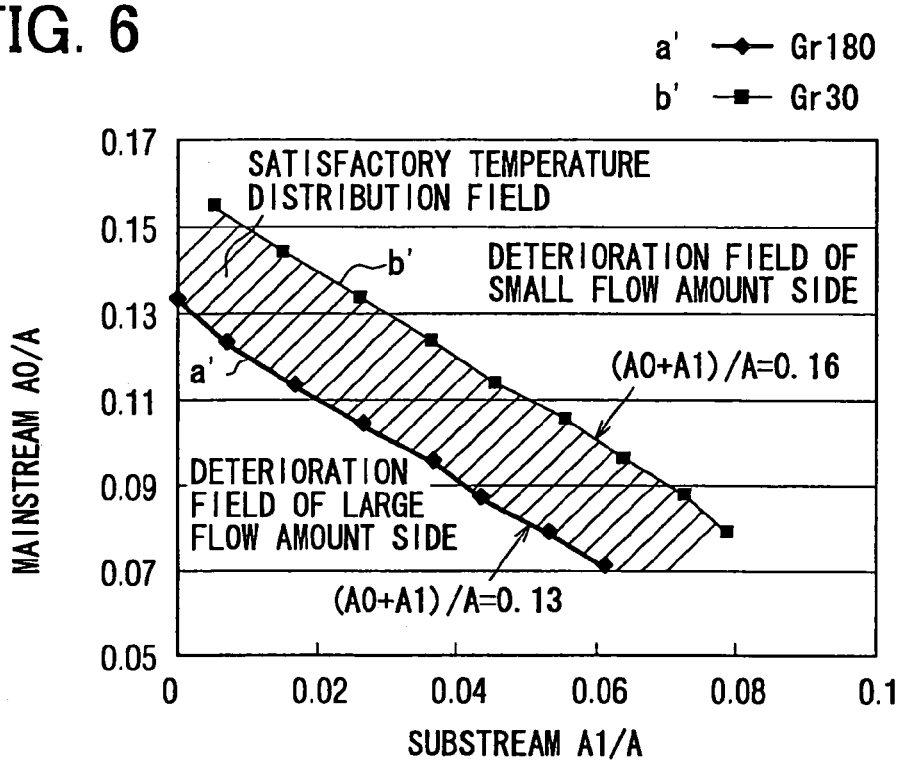
FIG. 6 is diagram showing a relation between a satisfactory temperature distribution field and opening area ratios of the mainstream opening portion and the substream opening portion according to the first embodiment.

Specifically, as shown in FIG. 6, the experiment is performed to calculate a boundary value between a satisfactory temperature distribution field and a deterioration temperature distribution field based on the opening area ratio A0/A of the mainstream opening 191 and the opening area ratio A1/A of the substream opening 192 in the case of the low flow amount (30 kg/h) of refrigerant, and a boundary value of that in the case of the high flow amount (180 kg/h) of refrigerant.

Referring to FIG. 6, a' indicates the boundary value in the case of the high flow amount (180 kg/h) of refrigerant, and b' indicates the boundary value in the case of the low flow amount (30 kg/h) of refrigerant. The satisfactory temperature distribution filed is positioned between the boundary value a' and the boundary value b'.

As shown in FIG. 6, the opening area ratio (A0+A1)/A of the mainstream opening 191 and the substream opening 192 to the inflow port member 190 is equal to about 0.13 at the side of the boundary value a', and equal to about 0.16 at the side of the boundary value b'. Therefore, the satisfactory temperature distribution field can be obtained when the mainstream opening 191 and the substream opening 192 are formed so that the opening area ratio (A0+A1)/A is substantially in the range of 0.13-0.16.

Figure 7:
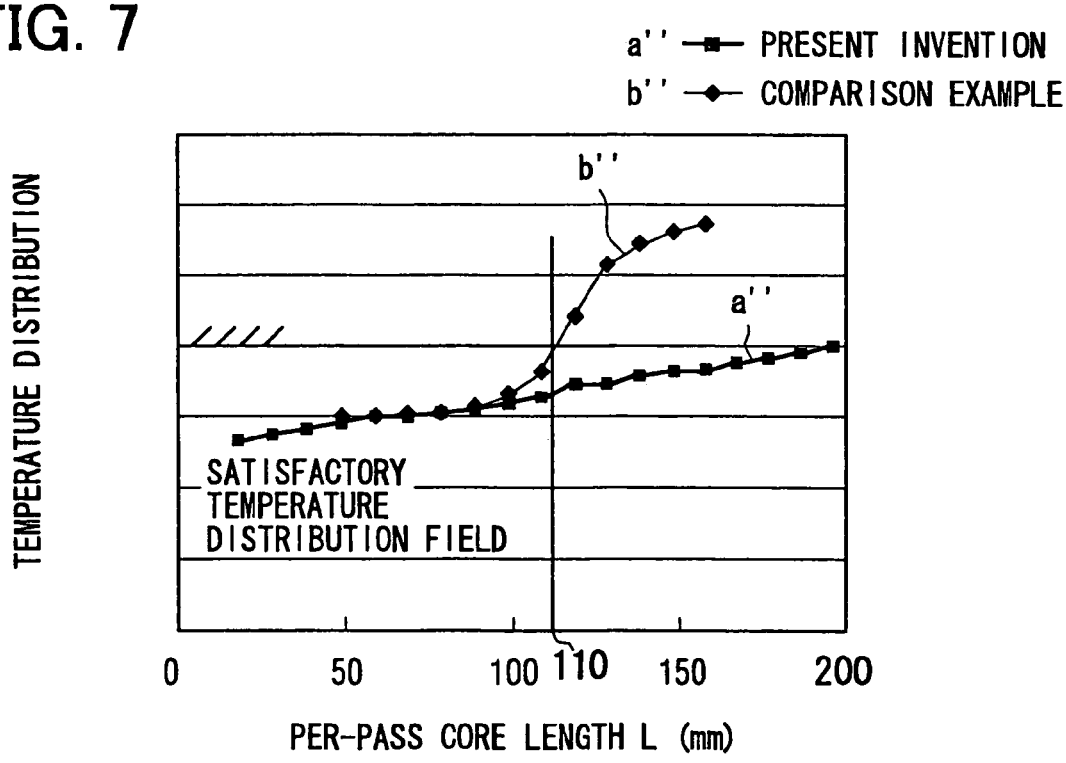
FIG. 7 is a diagram showing a relation between a temperature distribution and a per-pass core length according to the first embodiment and that according to a comparison example.

FIG. 7 shows the relation between the temperature distribution and the per-pass core length L according to a comparison example (referring to JP-2005-30741A) where a partition plate flow-divides refrigerant (having been introduced) into the portion (of inlet side passage) near a inflow port of the inlet side passage and the longitudinal-direction inner portion of the inlet side passage, and the relation between those according to the present invention where the inflow port member 190 is provided. In FIG. 7, a" indicates the relation according to the present invention, and b" indicates the relation according to the comparison example.

Referring to FIG. 7, according to the present invention, the temperature distribution can keep satisfactory in the case where the per-pass core length L is smaller than or equal to 200 m or so, although the temperature distribution gradually deteriorates with an increase of the per-pass core length L. According to the comparison example, the temperature distribution will deteriorate when the per-pass core length L is larger than 110 mm or so. Moreover, there exists at b" an inflection point which indicates that the temperature distribution violently deteriorates. The inflection point is positioned at b" where the per-pass core length L is equal to about 100 m.

Therefore, the value of the per-pass core length L of the heat exchanger according to the present invention can be set in a larger range while a satisfactory temperature distribution can be provided. In this embodiment, the two-pass type heat exchanger 100 is provided, and the per-pass core length L is set substantially in the range of 150 mm-200 m.

According to this embodiment, the mainstream opening 191 is arranged at the small-diameter end of the funnel-shaped portion (nozzle) of the inflow port member 190, so that the pressure loss of refrigerant flowing through the inflow port member 190 is reduced. Thus, the efficiency of the refrigerant cycle system is improved.

As described above, the circulation portion 151 of the header tank 140*a* is partitioned into the inlet side passage 151*a* and other passages 151*c*, 151*b*. The inflow port member 190, which is provided with the mainstream opening 191 and the substream opening 192 for causing at least the mainstream flow and the substream flow of refrigerant, is arranged at the one end of the inlet side passage 151*a*. The mainstream opening 191 and the substream opening 192 are provided so that the mainstream flow of refrigerant is limited by the substream flow of refrigerant. Thus, refrigerant flowing toward the tubes 110 is evenly flow-divided.

That is, in the case of the small flow amount of refrigerant, the large part of refrigerant which flows through the inflow port member 190 into the inlet side passage 151*a* in the longitudinal direction thereof will flow through the mainstream opening 191 into the part (of inlet side passage 151*a*) near the inflow port member 190 (fluid inlet 210), to cause the mainstream flow with a low flow speed. Moreover, the small part of refrigerant will flow into the longitudinal-direction inner portion of the inlet side passage 151*c* through the substream opening 192, to cause the substream flow having a high flow speed.

On the other hand, when the refrigerant flow amount is large (in this case, it is generally difficult for refrigerant mainstream flow to flow into the part of inlet side passage 151*a* near fluid inlet 210), the mainstream flow can flow into the part of the inlet side passage 151*a* near the fluid inlet 210 due to the substream flow caused by the substream opening 192 according to this embodiment.

Accordingly, refrigerant can be evenly flow-divided into the tubes 110 from the inlet side passage 151*a*, even when refrigerant introduced into the heat exchanger 100 is provided with a large flow amount range.

Specifically, the heat exchanger 100 is provided with the mainstream opening 191 which has the opening area A0 smaller than the cross section area A of the inlet side passage 151*a*, and the substream opening 192 which has the opening area A1 smaller than that of the mainstream opening 191. The substream opening 192 is arranged at the upper side of the mainstream opening 191.

Therefore, when refrigerant flows from the upper header tank 140*a* toward the lower header tank 140*b*, refrigerant of the mainstream flow from the mainstream opening 191 is limited by the substream flow flowing at the upper side of the mainstream flow, to easily flow into the portion (near inflow port member 190) of the inlet side passage 151*a*.

Thus, in the case of the large flow amount of refrigerant, refrigerant of the mainstream flow can flow into both the longitudinal-direction inner portion of the inlet side passage 151*a* and the portion (of inlet side passage 151*a*) near the inflow port member 190, due to the substream flow of refrigerant. Accordingly, the heat exchanger 100 according to the present invention can be used in the large flow amount range of refrigerant.

Moreover, the fluid inlet 210 is constructed so that refrigerant flows from the lower side of the inflow port member 190 into the mainstream opening 191 and the substream opening 12. The fluid inlet 210 is disposed at the lower side of the inflow port member 190. Thus, the mainstream flow of refrigerant which flows from the mainstream opening 191 and upwards flows due to the inertial force thereof can be changed to downwards flow by the substream flow of refrigerant which is introduced from the substream opening 192 at the upper side of the mainstream opening 191. Accordingly, refrigerant from the mainstream opening 191 can easily flow into the portion (of inlet side passage 151*a*) near the fluid inlet 201, so that refrigerant from the header tanks 140*a* and 140*b* can be evenly flow-divided into all the tubes 110 of the heat exchanger 100.

Furthermore, according to the present invention, the optimal opening area ratio (A0+A1)/A is set substantially in the range of 0.13-0.16, so that the heat exchanger 100 with the satisfactory temperature distribution can be provided even when being used in the large flow amount range (e.g., 30-180 kg/h) of refrigerant.

The tubes 110 of the heat exchanger 100 are stacked in the longitudinal direction of the inlet side passage 151*a* (header tank 140*a*) and communicated with the inlet side passage 151*a*, so that the inlet side passage 151*a* is sized according to the per-pass core length L. According to this embodiment, the per-pass core length L can be set up to about 200 mm so that the inlet side passage 151*a* can be also enlarged, as compared with the comparison example where the per-pass core length L is smaller than or equal to 110 mm or so. Therefore, according to this embodiment, the pass number of the heat exchanger 100 can be reduced. Thus, the heat exchanger 100 can be suitably used as the evaporator of a vehicle air conditioner and the like.

Furthermore, according to the comparison example, there exits the inflection point (when per-pass core length L is equal to about 100 m) at b" of the relation between the temperature distribution and the per-pass core length L. According to the present invention, the inflection point disappears so that a stable satisfactory temperature distribution can be provided even when the air conditioner operation state varies.

Moreover, according to the present invention, the substream opening 192 is positioned between the tangents of the right end and the left end of the mainstream opening 191 so that the satisfactory temperature distribution can be provided. That is, the substream opening 192 is arranged at the optimal position. Furthermore, the mainstream opening 191 is disposed at the small-diameter end of the funnel-shaped portion (i.e., nozzle portion) of the inflow port member 190, so that the pressure loss can be reduced. Accordingly, the efficiency of the refrigerant cycle system can be improved.

According to this embodiment, the tubes 110 (of going tube group or returning tube group) of each of the core members of the core unit 101 are stacked in the longitudinal-direction of the header tank 140*a*, 140*b*. The going tube group and the returning tube group are respectively arranged at the rear side (air downstream side) and the front side (air upstream side) with respect to the exterior air flowing direction. Refrigerant flow direction in the going tube group is contrary to that in the returning tube group. The interiors of the going tube group and the return tube group are communicated with the circulation portions 151 of the header tanks 140*a* and 140*b*. Fluid flows through the tubes 110 and the header tank 140*a*, 140*b* by at least one pass in a front-rear U-turn manner. Therefore, the pressure loss can be significantly reduced, thus improving the efficiency of the refrigerant cycle system. Accordingly, the evaporator 100 can be small-sized.

Second Embodiment

In the above-described first embodiment, the mainstream opening 191 is arranged at the small-diameter end of the funnel-shaped portion (i.e., nozzle portion) of the inflow port member 190, and the substream opening 192 having the substantial flat shape (e.g., ellipse) is formed at the inflow port member 190. According to a second embodiment of the present invention, the mainstream opening 191 and the substream opening 192 can be also provided with other arrangements.

Figure 8A:
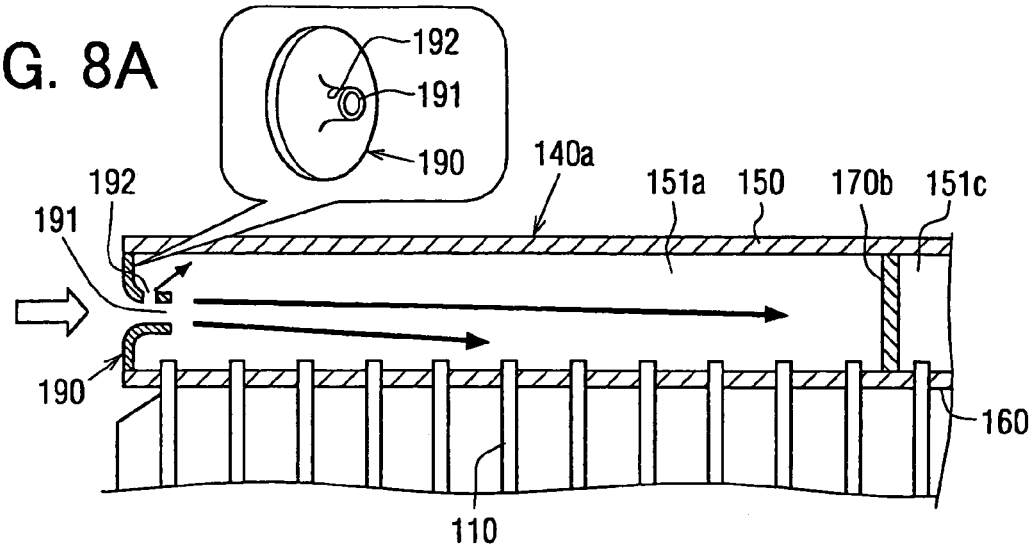
FIG. 8A is a partial schematic longitudinal sectional view showing an inner construction of a header tank according to a second embodiment of the present invention.

For example, as shown in FIG. 8A, the substream opening 192 can be a penetration hole formed at an upper (with respect to gravity direction) wall portion of the funnel-shaped portion (nozzle-shaped portion) of the inflow port member 190. The wall portion defines a fluid passage in the nozzle-shaped portion, and the mainstream opening 191 is disposed at the end of the fluid passage. Thus, the function of the flow of substream refrigerant will not be weakened, and the flow of the mainstream refrigerant can be restricted.

Figure 8B:
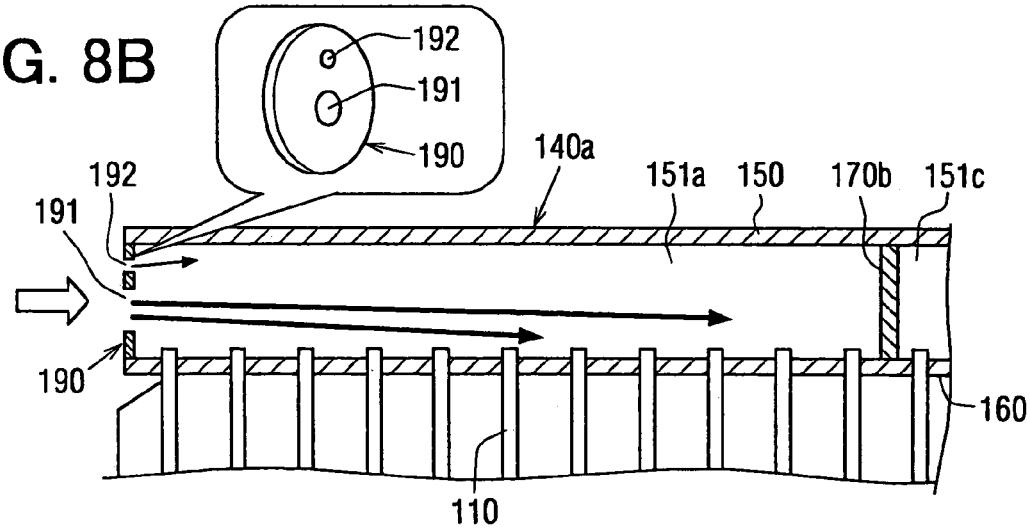
FIG. 8B is a partial schematic longitudinal sectional view showing an inner construction of a header tank according to a first modification of the second embodiment.

According to a first modification of the second embodiment, as shown in FIG. 8B, each of the mainstream opening 191 and the substream opening 192 can be an orifice formed at the inflow port member 190 which has a substantial flat plate shape, for example. The substream opening 192 can have a substantial ellipse shape or a substantial round shape, for example.

Figure 8C:
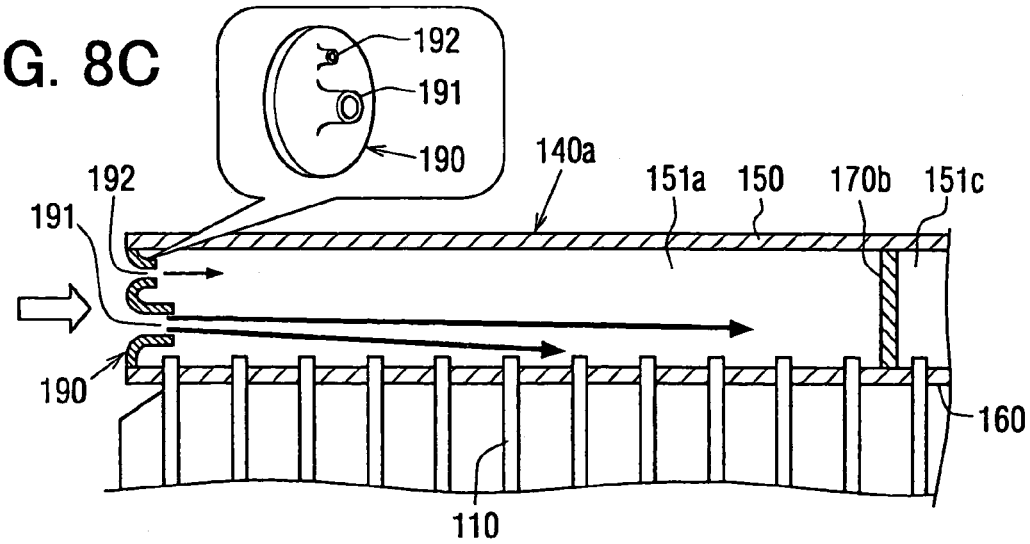
FIG. 8C is a partial schematic longitudinal sectional view showing an inner construction of a header tank according to a second modification of the second embodiment.

According to a second modification of the second embodiment, referring to FIG. 8C, the inflow port member 190 can be provided with two funnel portions (i.e., nozzle portions). In this case, the mainstream opening 191 and the substream opening 192 are respectively arranged at the small-diameter ends of the funnel-shaped portions. Thus, the pressure loss of refrigerant can be further reduced.

The construction of the heat exchanger 100 which is not described in the second embodiment is same with what has been described in the first embodiment.

Third Embodiment

According to a third embodiment of the present invention, the mainstream opening 191 and the substream opening 192 can be provided with other shapes.

Figure 9A:
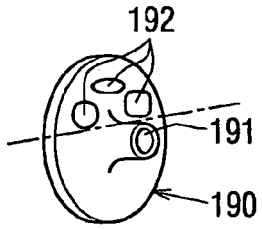
FIG. 9A is a perspective view showing an inflow port member according to a third embodiment of the present invention.

For example, as shown in FIG. 9A, the inflow port member 190 can be provided with the mainstream opening 191 and the multiple substream openings 192, which are arranged at the upper side of the mainstream opening 191. In this case, the substream opening 192 can be also provided with other shapes in addition to the substantial ellipse shape.

Moreover, the position of the substream opening 192 at the inflow port member 190 can be not limited between the tangents of the right end and the left end of the mainstream opening 191. In this case, because the position of the substream opening 192 deviates from the above-described optimal position thereof, the optimal opening area ratio will be narrowed as compared with that described above.

Figure 9B:
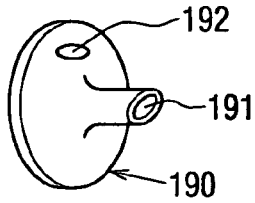
FIG. 9B is a perspective view showing an inflow port member according to a first modification of the third embodiment.

According to a first modification of the third embodiment, as shown in FIG. 9B, the mainstream opening 191 formed at the nozzle-shaped portion of the inflow port member 190 can be provided with a longer burring at the upper portion thereof, so that the mainstream opening 191 faces downwards. Thus, the mainstream flow of refrigerant from the mainstream opening 191 can be restricted to flow downwards.

Figure 9C:
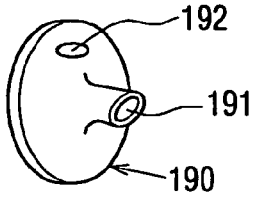
FIG. 9C is a perspective view showing an inflow port member according to a second modification of the third embodiment.

According to a second modification of the third embodiment, as shown in FIG. 9C, the tip of the small-diameter end (where mainstream opening 191 is arranged) of the nozzle-shaped portion of the inflow port member 190 can be shaped to face downwards, so that the mainstream flow of refrigerant from the mainstream opening 191 can be restricted to flow downwards.

Figure 9D:
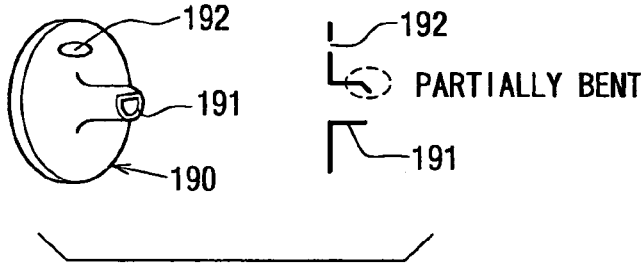
FIG. 9D is a perspective view showing an inflow port member according to a third modification of the third embodiment.

According to a third modification of the third embodiment, as shown in FIG. 9D, the upper portion of the small-diameter end (where mainstream opening 191 is arranged) of the nozzle-shaped portion of the inflow port member 190 can be partially bent to face downwards, so that the mainstream refrigerant flows downwards.

Figure 9E:
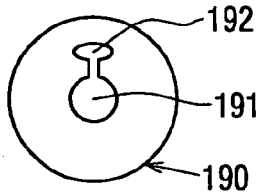
FIG. 9E is a plan view showing an inflow port member according to a fourth modification of the third embodiment.

According to a fourth modification of the third embodiment, as shown in FIG. 9E, the mainstream opening 191 and the substream opening 192 can be also formed to communicate with each other at the inflow port member 190, on condition that the mainstream flow and the substream flow of refrigerant can be provided.

The construction of the heat exchanger 100 which is not described in the third embodiment is same with what has been described in the first embodiment.

Fourth Embodiment

In the above-described embodiments, the inlet side passage 151*a* is formed in the upper header tank 140*a*, and the inflow port member 190 is disposed at the upper side of the upper end of the tube 110.

Figure 10:
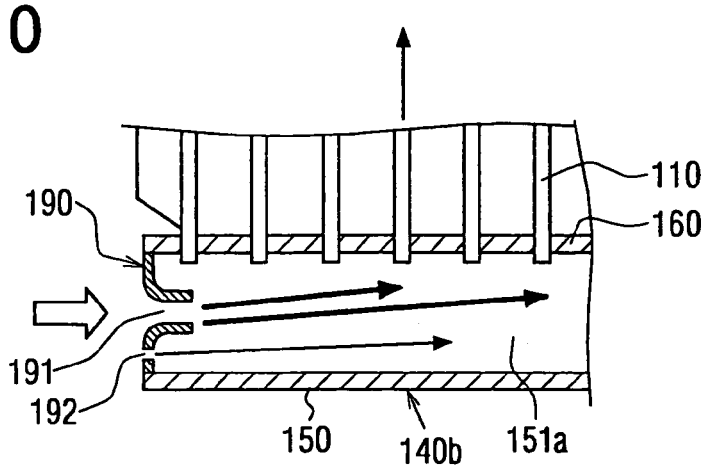
FIG. 10 is a partial schematic longitudinal sectional view showing an inner construction of a header tank according to a fourth embodiment of the present invention.

According to a fourth embodiment of the present invention, as shown in FIG. 10, the inlet side passage 151*a* is arranged in the lower header tank 140*b*. The inflow port member 190 provided with the mainstream opening 191 and the substream opening 192 is disposed in the inlet side passage 151*a*, and positioned at the lower side of the lower end of the tube 110.

In this case, refrigerant is to flow from the lower header tank 140*b* toward the upper header tank 140*a*. The substream opening 192 is arranged at the lower side of the mainstream opening 191. Thus, the mainstream flow (from mainstream opening 191), which generally flows downwards due to the inertial force thereof, can be restricted by the substream flow caused by the substream opening 192 to flow upwards. Therefore, refrigerant can be evenly flow-divided from the inlet side passage 151*a* of the lower header tank 140*b* to the tubes 110 of the heat exchanger 100.

The construction of the heat exchanger 100 which is not described in the fourth embodiment is same with what has been described in the first embodiment.

Other Embodiments

Although the present invention has been fully described in connection with the preferred embodiments thereof with reference to the accompanying drawings, it is to be noted that various changes and modifications will become apparent to those skilled in the art.

In the above-described embodiments, the present invention is suitably used for the two-pass U-turn type heat exchanger 100.

Figure 11:
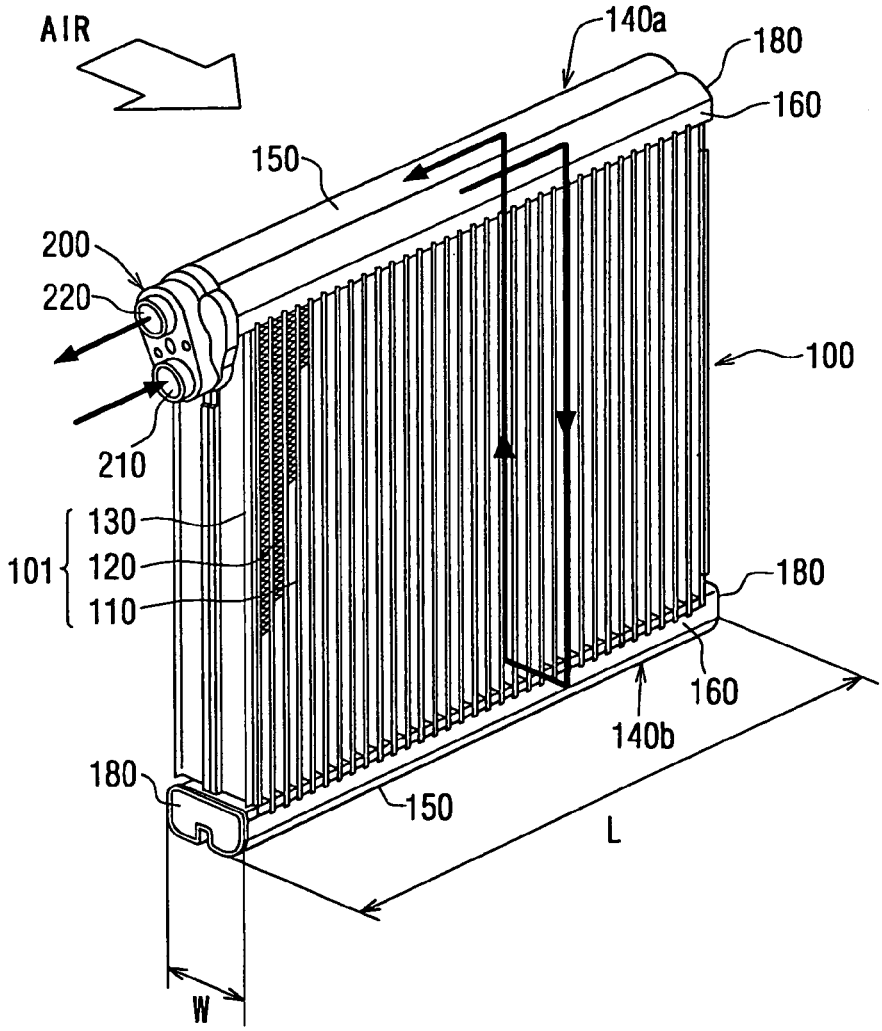
FIG. 11 is a perspective view showing a whole construction of an evaporator according to other embodiment of the present invention.

However, referring to FIG. 11, the present invention can be also used for the heat exchanger 100 of a one-pass U-turn type, in which the tubes 110 are divided into at least one going tube group and at least one returning tube group. The going tube group and the returning tube group are respectively arranged at the rear side (air downstream side) and the front side (air upstream side) with respect to the exterior air flow direction. Fluid in the tube 110 of the returning tube group has a flow direction contrary to that in the tube of the going tube group. Fluid flows through the tubes 110 and the header tank 140*a*, 140*b* by one pass in a front-rear U-turn manner.

Moreover, in the above-described embodiments, the fluid inlet 210 is arranged so that refrigerant flows from the lower side of the inflow port member 190 into the mainstream opening 191 and the substream opening 192. However, the fluid inlet 210 can be also disposed so that refrigerant flows into the mainstream opening 191 and the substream opening 192 in the horizontal direction.

Such changes and modifications are to be understood as being in the scope of the present invention as defined by the appended claims.

What is claimed is:

1. A heat exchanger comprising:

a plurality of tubes which are stacked; and a header tank defining therein a circulation portion in which fluid flows, the header tank extending in a stacking direction of the tubes, wherein:

the header tank is connected with a longitudinal-direction end of each of the tubes so that the circulation portion communicates with interiors of the tubes, the circulation portion being partitioned into an inlet side passage and at least one other passage; and the header tank has an inflow port member which is arranged at a longitudinal-direction end of the inlet side passage and provided with a single center mainstream opening defining a mainstream flow to a central portion of the circulation portion of the header tank and a substream opening defining a substream flow of fluid introduced toward the tubes, the single center mainstream opening and the substream opening being the only openings in the inflow member, the entire substream opening being located further from the longitudinal-direction end of each of the tubes than the single center mainstream opening.

2. The heat exchanger according to claim 1, wherein the mainstream opening has an opening area which is smaller than a cross section area of the inlet side passage, and the substream opening has an opening area which is smaller than the opening area of the mainstream opening;

the longitudinal-direction end of the tube which is connected with the header tank is one of an upper end and a lower end of the tube;

when the longitudinal-direction end of the tube which is connected with the header tank is the upper end of the tube, the inflow port member is arranged at an upper side of the upper end of the tube and the substream opening is disposed at an upper side of the mainstream opening; and when the longitudinal-direction end of the tube which is connected with the header tank is the lower end of the tube, the inflow port member is arranged at a lower side of the lower end of the tube and the substream opening is disposed at a lower side of the mainstream opening.

3. The heat exchanger according to claim 2, wherein:

the header tank has a fluid inlet through which fluid is introduced into the circulation portion of the header tank, the fluid inlet being arranged at a fluid upstream side of the inflow port member; and when the longitudinal-direction end of the tube which is connected with the header tank is the upper end of the tube, the fluid inlet is disposed below the inflow port member.

4. The heat exchanger according to claim 2, wherein the inflow port member is constructed so that (A0+A1)/A is substantially in a range of 0.13-0.16, where A indicates the cross section area of the inlet side passage, A0 indicates the opening area of the mainstream opening, and A1 indicates the opening area of the substream opening.

5. The heat exchanger according to claim 4, wherein the tubes which are stacked and communicated with the inlet side passage are provided with a per-pass core length L which is smaller than or equal to about 200 mm.

6. The heat exchanger according to claim 2, wherein the substream opening is arranged between a tangent to a right end of the mainstream opening and a tangent to a left end thereof.

7. The heat exchanger according to claim 2, wherein at least one of the mainstream opening and the substream opening is constructed of an end of a nozzle portion of the inflow port member.

8. The heat exchanger according to claim 1, wherein:

the tubes which are stacked in a longitudinal direction of the header tank are divided into at least one going tube group and at least one returning tube group;

fluid in the tube of the returning tube group has a flow direction contrary to that in the tube of the going tube group; and the going tube group and the returning tube group are respectively arranged at a rear side and a front side in an exterior air flow direction, so that fluid flows in the tubes and the circulation portion of the header tank in a front-rear U-turn manner.

9. The heat exchanger according to claim 7, wherein:

the nozzle portion is disposed at a substantial center of the inflow port member and has a substantial conical funnel shape; and the mainstream opening is constructed of a small-diameter end of the nozzle portion.

10. The heat exchanger according to claim 9, wherein the mainstream opening is disposed at a further inner side of the inlet side passage with respect to the substream opening.

11. The heat exchanger according to claim 7, wherein the mainstream opening is formed at the end of the nozzle portion, the end being provided with a longer burring at an upper portion thereof.

12. The heat exchanger according to claim 7, wherein the mainstream opening is formed at the end of the nozzle portion, the end facing downwards.

13. The heat exchanger according to claim 7, wherein the mainstream opening is formed at the end of the nozzle portion, an upper portion of the end being partially bent to face downwards.

14. The heat exchanger according to claim 1, wherein the mainstream opening and the substream opening are formed to communicate with each other at the inflow port member.

15. A heat exchanger comprising:

a plurality of tubes which are stacked; and a header tank defining therein a circulation portion in which fluid flows, the header tank extending in a stacking direction of the tubes, wherein:

the header tank is connected with a longitudinal-direction end of each of the tubes so that the circulation portion communicates with interiors of the tubes, the circulation portion being partitioned into an inlet side passage and at least one other passage; and the header tank has an inflow port member which is arranged at a longitudinal-direction end of the inlet side passage and provided with a single mainstream opening defining a mainstream flow and a substream opening defining a substream flow of fluid introduced toward the tubes, the single mainstream opening and the substream opening being the only openings in the inflow member, the entire substream opening being located further from the longitudinal-direction end of each of the tubes than the single mainstream opening, the mainstream opening being larger than the substream opening.

* * * * *